US007302208B2

(12) United States Patent
Tsuda et al.

(10) Patent No.: US 7,302,208 B2
(45) Date of Patent: Nov. 27, 2007

(54) UNIT SUPPORTING DEVICE AND IMAGE FORMING APPARATUS

(75) Inventors: Masaaki Tsuda, Kanagawa (JP); Tsutomu Katoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 233 days.

(21) Appl. No.: 11/074,670

(22) Filed: Mar. 9, 2005

(65) Prior Publication Data

US 2005/0231821 A1 Oct. 20, 2005

(30) Foreign Application Priority Data

Mar. 31, 2004 (JP) ..... 2004-105717

(51) Int. Cl.
*G03G 15/16* (2006.01)

(52) U.S. Cl. ..... 399/121

(58) Field of Classification Search ..... 399/111, 399/121, 126, 117, 124
See application file for complete search history.

(56) References Cited

U.S. PATENT DOCUMENTS

| | | | | |
|---|---|---|---|---|
| 5,138,372 | A * | 8/1992 | DeCecca | 399/111 |
| 5,138,374 | A * | 8/1992 | Bellis | 399/111 |
| 5,835,822 | A * | 11/1998 | Nagasaki et al. | 399/111 |
| 6,445,895 | B2 * | 9/2002 | Shirasawa et al. | 399/121 |
| 6,522,848 | B2 * | 2/2003 | Wakana | 399/121 |
| 7,079,783 | B2 * | 7/2006 | Yokoi | 399/111 |
| 2004/0009008 | A1 * | 1/2004 | Park et al. | 399/121 |
| 2005/0231821 | A1 | 10/2005 | Tsuda et al. | |

FOREIGN PATENT DOCUMENTS

| | | | |
|---|---|---|---|
| JP | 8-87224 | | 4/1996 |
| JP | 2000-47450 | | 2/2000 |
| JP | 2000-227696 | | 8/2000 |
| JP | 3101270 | | 8/2000 |
| JP | 2000-259009 | | 9/2000 |
| JP | 2001-281962 | | 10/2001 |
| JP | 3279365 | | 2/2002 |
| JP | 200272607 | | 3/2002 |
| JP | 2002123051 | A * | 4/2002 |
| JP | 2003207977 | A * | 7/2003 |
| JP | 2004053819 | A * | 2/2004 |

OTHER PUBLICATIONS

U.S. Appl. No. 11/414,176, filed May 1, 2006, Adachi, et al.
U.S. Appl. No. 11/608,175, filed Dec. 7, 2006, Kuma et al.

* cited by examiner

*Primary Examiner*—Susan Lee
(74) *Attorney, Agent, or Firm*—Oblon, Spivak, McClelland, Maier & Neustadt, P.C.

(57) ABSTRACT

A unit supporting device supports a unit that can be inserted into an accommodating position and pulled out to an operable position while defining a position of the unit with respect to a member opposite to the unit. A configuration for setting a positional relationship between the unit and the member in a process in which the unit is inserted toward the accommodating position is provided on the unit and the member.

19 Claims, 7 Drawing Sheets

UNIT SUPPORTING DEVICE AND IMAGE FORMING APPARATUS

CROSS-REFERENCE TO RELATED APPLICATIONS

The present document incorporates by reference the entire contents of Japanese priority document, 2004-105717 filed in Japan on Mar. 31, 2004.

BACKGROUND OF THE INVENTION

1) Field of the Invention

The present invention relates to a unit supporting device and an image forming apparatus, and more particularly to a configuration for defining a positional relationship between a plurality of units and a member opposed thereto when each of the units is inserted into an accommodating position.

2) Description of the Related Art

In image forming apparatuses such as a reproducing machine, a printer, a facsimile machine, or printing machine, a record output can be obtained by performing a visualizing processing on an electrostatic latent image formed on a photoconductor, being a latent image carrier, by a developing device to transfer a-visualized image on a sheet or the like.

There are not only a configuration where a single photoconductor is provided for processing with only a single color, but also a configuration where a plurality of photoconductors are provided for forming an image for each plural colors. The latter case is used to form a multi-color image including a full color image.

For example, as a system for obtaining a full color image, there are a system that color images formed on respective photoconductors using developing agent such as toners with colors put in a complementary color relationship with colors for separating color are sequentially transferred on a conveying sheet in a superimposing manner and a system that, after color images on respective photoconductors are sequentially transferred on an intermediate transfer member, images transferred on the intermediate transfer member in a superimposing manner are transferred on a sheet in batch.

On the other hand, as one of configurations where a plurality of photoconductors are used, in the latter system of the systems, a configuration where photoconductors on which respective color images can be formed are arranged along a direction in which a belt serving as an intermediate transfer-member on which images are transferred from the photoconductors in a superimposing manner extends, so-called "tandem structure" is known (see, for example, Japanese Patent Application Laid-open No. 2001-281962).

In the image forming apparatuses, since part replacements and maintenance/inspection of respective devices used for image formation processing, so-called imaging devices, are conducted, such a configuration which the imaging devices can be pulled from their accommodating positions to their positions where they can be operated externally is employed.

In Japanese Patent Application Laid-open No. 2001-281962, a configuration for pulling out these devices to the positions where they can be operated externally is disclosed. Specifically, an image formation processing unit for each color is integrally configured of a unit having a developing device including a photoconductor used for image formation processing and a replenishing unit for such developing agent as toner used in the developing device and the like, and a unit including the photoconductor, a charging device, and a cleaning device. Such a configuration is employed that the image formation processing units corresponding to respective color are arranged in respective imaging stations and one image formation processing unit including a device to be replaced of these units is pulled out of the image forming apparatus main unit.

On the other hand, in such a tandem structure, there is a configuration provided with a transfer unit including a transfer belt as a transfer member passing through the imaging station. A configuration where the transfer unit approaches to and separates from the imaging station in order to avoid troubles such as jamming is proposed (see, for example, Japanese Patent Application Laid-open No. 2000-47450).

When images with plural color images are sequentially transferred, it is important to employ such a configuration that out of color registration is not caused by positional deviation between respective images in order to prevent image quality from being degraded.

In view of these circumstances, conventionally, such a configuration is proposed that positional deviations in superimposition among plural colors are prevented by shifting a movement amount of a photoconductor driving motor according to a deviation between a write timing on the photoconductor and a detection timing on a reference mark formed on a transfer member (see, for example, Japanese Patent Application Laid-open No. 2002-72607).

As the configuration for preventing out of color registration disclosed in Japanese Patent Application Laid-open No. 2002-72607, a mark detecting sensor supported by the image forming apparatus main unit so as to be opposed to the transfer member is used. However, in a configuration where the transfer unit including the transfer member approaches to and separates from the imaging station, as disclosed in Japanese Patent Application Laid-open No. 2000-47450, when the transfer unit can be inserted into and pulled out of a case of the apparatus main unit, there is a possibility that, when a positional relationship between the transfer member of the transfer unit inserted into the case and the mark detecting sensor deviates from a proper one, accurate control for preventing out of color registration cannot be achieved, as disclosed particularly in Japanese Patent Application Laid-open No. 2000-47450.

As the configuration for preventing out of color registration, there is the following configuration. A supporting leg fitted into an elongated hole formed in a side plate of the case to extend in a direction perpendicular to an inserting direction of the transfer unit is provided on a supporting stand for a writing unit, a supporting pin fitted into an elongated hole formed in a supporting portion of the case to extend along a direction parallel to the inserting direction of the transfer unit is provided on the supporting stand. In an insertion of the transfer unit into the case at an image forming time, a displacement of the supporting pin in a direction parallel to the inserting direction occurs, when the supporting leg positioned on the supporting stand for the writing unit is fitted into the elongated hole formed in the direction perpendicular to the inserting direction. The displacement is made possible in the elongated hole formed in the supporting portion of the case to extend in the inserting direction, so that positioning of the writing unit in the inserting direction and correction of inclination thereof are performed.

In this configuration, however, it is assumed that the supporting pin of the supporting stand for the writing unit is fitted into the elongated hole formed in the supporting portion for the case to extend in the direction perpendicular to the unit inserting direction in an upwardly moving course of the transfer unit from a downwardly moved position thereof. Therefore, it is necessary to conduct a positioning work after the transfer unit is once inserted instead of the positioning work conducted in the inserting course of the transfer unit, and an upwardly and downwardly moving mechanism for the transfer unit must be provided. In addition, the operation for positioning becomes complicated, and the entire configuration inevitably becomes complicated.

Furthermore, since the configuration for positioning has a fitting structure for the elongated hole, there is a possibility that positioning accuracy cannot be secured because of a working error between the elongated hole and a member to be fitted therein.

On the other hand, in order to solve a problem occurring when a mark detecting sensor or a writing unit is provided on the side of the case for the transfer unit that can be inserted into and pulled out of the case, for example, it is considered that the mark detecting sensor is provided on the transfer unit. In this case, it may be necessary to detach the mark detecting sensor disposed near the transfer member at a time of transfer member replacement, which results in complication of replacement work. In addition, since life-span of the transfer unit to be replaced and that of the mark detecting sensor do not coincide with each other, replacement of the mark detecting sensor whose replacement is not required is conducted at a time of transfer unit replacement, which results in running cost increase.

Since the mark detecting sensor is a constituent element or a part requiring a power supply, it is necessary to furnish a grounded power supply line through a harness or the like. However, when the harness is used, it may obstruct a work for inserting and pulling-out for the transfer unit. Furthermore, a space for wiring is required, which may result in deterioration of workability and structure complication.

SUMMARY OF THE INVENTION

It is an object of the present invention to solve at least the above problems in the conventional technology.

A unit supporting device according to one aspect of the present invention supports a unit that can be inserted into an accommodating position and pulled out to an operable position while defining a position of the unit with respect to a member opposite to the unit. A configuration for setting a positional relationship between the unit and the member in a process in which the unit is inserted toward the accommodating position is provided on the unit and the member.

An image forming apparatus according to another-aspect of the present invention includes a unit supporting device that supports a unit that can be inserted into an accommodating position and pulled out to an operable position while defining a position of the unit with respect to a member opposite to the unit. A configuration for setting a positional relationship between the unit and the member in a process in which the unit is inserted toward the accommodating position is provided on the unit and the member.

The other objects, features, and advantages of the present invention are specifically set forth in or will become apparent from the following detailed description of the invention when read in conjunction with the accompanying drawings.

DETAILED DESCRIPTION

Exemplary embodiments according to the present invention will be explained below with reference to the accompanying drawings.

Figure 1:
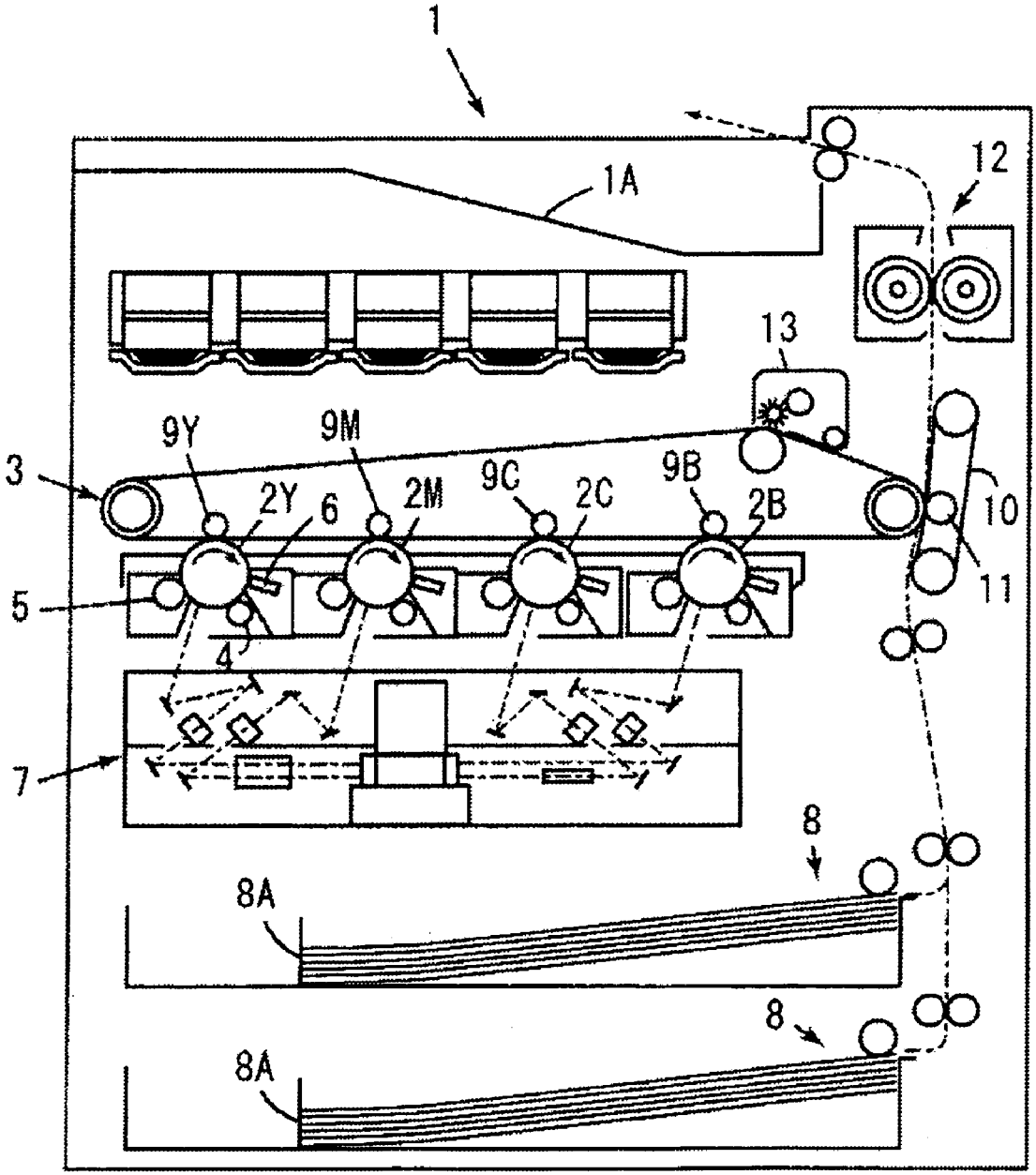
FIG. 1 is a schematic diagram for explaining a configuration of an image forming apparatus to which a unit supporting device according to an embodiment of the present invention is applied.

FIG. 1 is a schematic diagram of a configuration of an image forming apparatus to which a unit supporting device according to an embodiment of the present invention is applied. The image forming apparatus shown in FIG. 1 is a tandem system color printer described in Japanese Patent Application Laid-open No. 2001-281962, but the present invention is also not only applicable to a printer but also a reproducing machine, a facsimile machine, or a printing machine.

In FIG. 1, an image forming apparatus 1 is provided with photoconductors 2Y, 2M 2C, and 2B that can form images using yellow (Y), magenta (M), cyan (C), and black (B), which are toners with colors put in a complementary color relationship with color separation colors, and that are disposed in alignment with one another in a horizontal direction.

The respective photoconductors are integrally arranged in a photoconductor unit as one unit, and a transfer unit accommodating a transfer apparatus 3 using a belt having an extending face parallel to a direction of the arrangement of the photoconductors 2Y, 2M, 2C, and 2B is arranged above the photoconductor unit.

An imaging unit having devices 4, 5, and 6 for performing charging step, a developing step, and a, cleaning step of an image formation processing is arranged to correspond to each photoconductor in a lower portion of the photoconductor unit. A scanning device 7 used in a writing step is arranged below the imaging unit. In FIG. 1, reference numerals regarding the devices in the imaging unit are designated with only devices for yellow, but the same configuration is applied to devices for other colors.

The transfer apparatus 3 is provided for performing a primary transfer step of sequentially transferring color images from the respective photoconductors to an extending face of the belt opposed to the respective photoconductors and performing a secondary transfer step of transferring images superimposed in the primary transfer step to a sheet fed from a sheet feeding apparatus 8 (a plurality of sheet feeding cassettes 8A are provided in this case as shown in FIG. 1). Primary transfer devices 9Y, 9M, 9C, and 9B, each being configured of a roller, are arranged at positions opposed to the respective photoconductors in the transfer apparatus 3, and a secondary transfer device 11 configured of a conveyor belt 10 and rollers that convey a sheet while causing the sheet to come in contact with the transfer apparatus 3 is arranged at a secondary transfer position.

In the color printer or image forming apparatus 1, when electrostatic latent images are formed on the respective photoconductors according to writing scanning after charging the respective photoconductors and the electrostatic latent images are visualized by the developing devices 5, color images are sequentially transferred from the respective photoconductors to the transfer apparatus 3 via the primary transfer devices 9Y, 9M, 9C, and 9B so that superimposed images are formed on the belt. The superimposed images are transferred on a sheet by the secondary transfer device 11 in batch.

The sheet transferred with the superimposed images from the transfer apparatus 3 in batch is fused by a fusing device 12 provided in a conveying path reaching a paper ejection tray 1A and is then discharged to the tray 1A. In FIG. 1, reference numeral 13 designates a cleaning device for the belt used in the transfer apparatus 3.

Figure 2A:
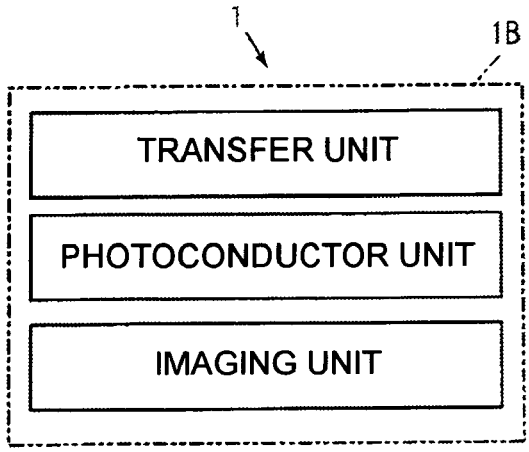
FIGS. 2A and 2B are schematic diagrams for explaining the reason why a device for imaging used in the image forming apparatus shown in FIG. 1 is unitized.
Figure 2B:
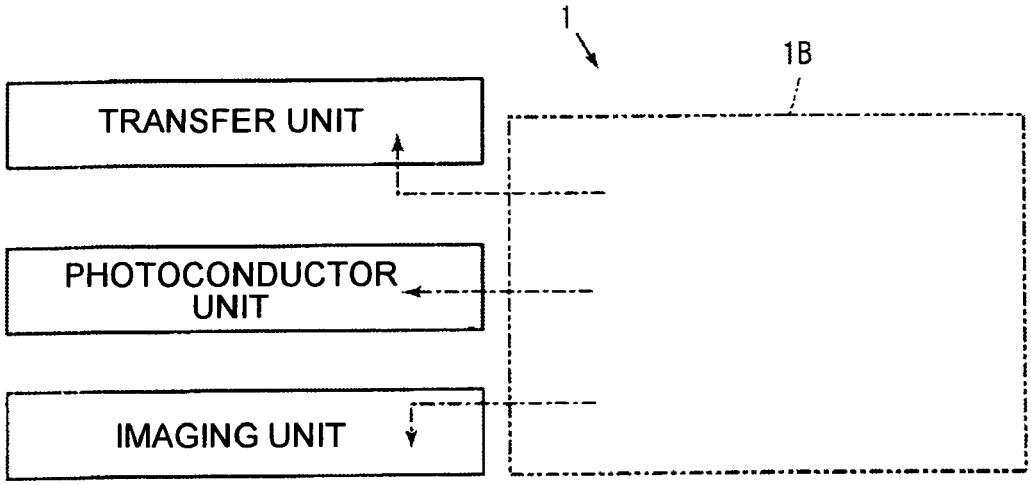

As shown in FIG. 2, the photoconductor unit, the transfer unit, and the imaging unit are movable between an accommodating position inside a case 1B of the color printer 1 (see FIG. 2A) and a pulling-out position at which these unit can be operated externally (see FIG. 2B). These units in the accommodating position are maintained in a relationship where they approach to one another or are pressed against one another, while the units at the pulling-out position are put in a relationship where they are spaced from one another. Particularly, the transfer unit and the imaging unit are separated in a vertical direction regarding a direction in which the photoconductor unit is moved in the course from the accommodating position to the pulling-out position. Such a movement relationship can prevent respective units from interfering with one another at a sliding or pulling-out time.

While each unit movable between the pulling-out position and the accommodating position is positioned at a predetermined position at its accommodated state, according to the present embodiment, a configuration for positioning a sensor bracket having sensors that can detect a position of a carried image and a density of the image and the transfer unit is provided to correspond to the transfer unit.

According to the present embodiment, a plural of sensors are provided to correspond to the number of photoconductors, in order to detect transfer positions of images formed by the respective photoconductors on the transfer belt serving as the transfer member provided in the transfer unit.

Detection of a position of an image performed by the sensor is for capturing information for preventing out of color registration due to a positional deviation between transferred images, and detected information is used for controlling a write timing and rotation of the photoconductor in response to a positional deviation between the transferred images.

Figure 3:
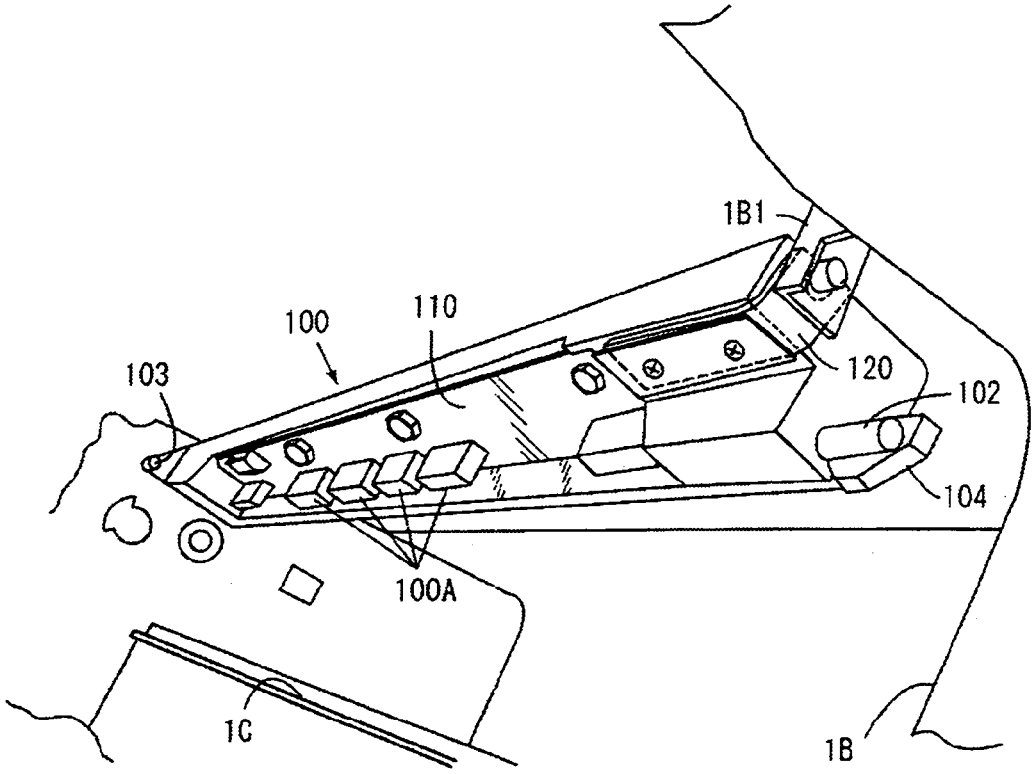
FIG. 3 is a perspective view for explaining a configuration of a sensor bracket used in the unit supporting device according to the present embodiment.

The configuration for positioning the sensor bracket and the transfer unit is shown in FIG. 3 and the subsequent drawings.

FIG. 3 is a perspective view of a configuration of the sensor bracket 100. The sensor bracket 100 is a resin molding member with an electrically insulating property whose longitudinal direction corresponds to a widthwise direction of a transfer unit 200 housing a belt-like transfer member (hereinafter, "a transfer belt", expediently) 200A therein, namely, a direction in which the transfer unit 200 is inserted in this embodiment. A plurality of (4 in this embodiment) sensors 100A corresponding to at least the number of photoconductors are provided on the sensor bracket 100 along the longitudinal direction thereof. In FIG. 3, reference numeral 1C designates a sliding guide portion serving at times of insertion and pulling-out of the transfer unit 200.

Figure 4A:
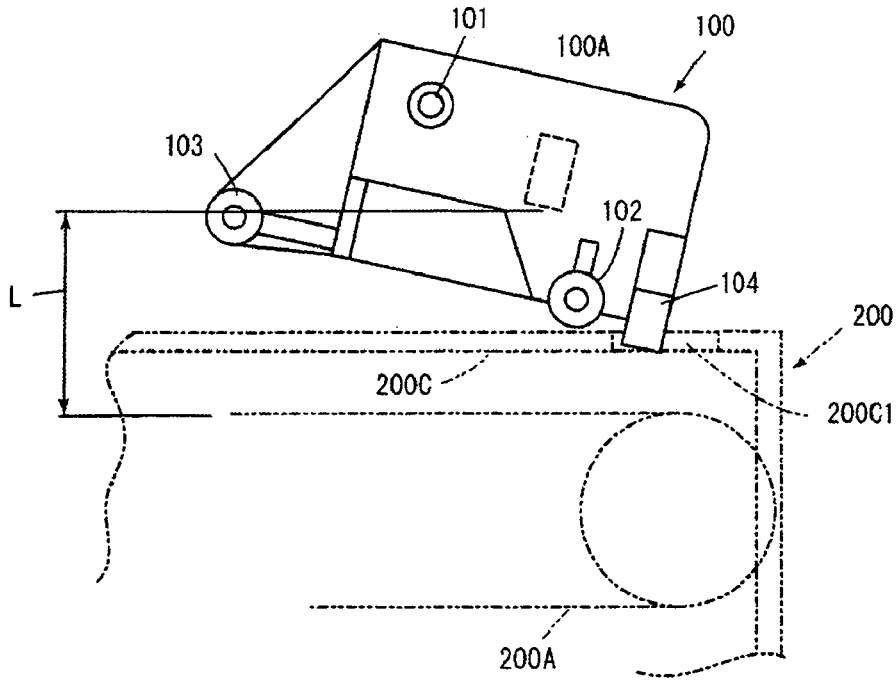
FIG. 4A is an explanatory view of an opposed state of a transfer unit and the sensor bracket used in the unit supporting device according to the present embodiment, with a state that a relative position of the transfer unit and the sensor bracket is defined.
Figure 4B:
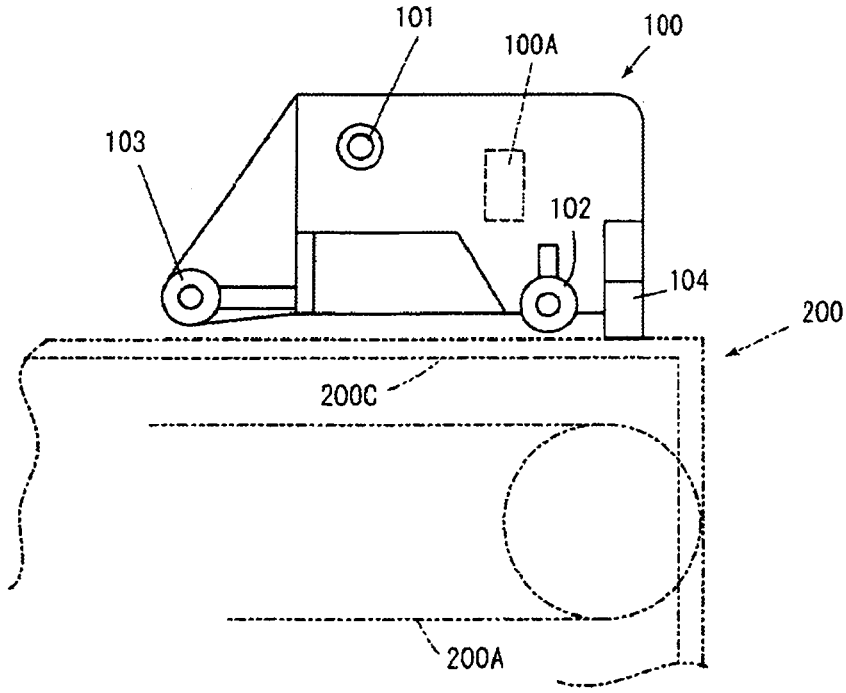
FIG. 4B is another explanatory view of the opposed state of the transfer unit and the sensor bracket used in the unit supporting device according to the present embodiment, with a state that the transfer unit is in the course of insertion thereof.

A supporting pin 101 is provided on one end wall 10B, in a longitudinal direction, of the sensor bracket 100, and the supporting pin 101 swingablly supports the sensor bracket 100 by inserting the supporting pin 101 into a supporting plate 101 provided on a case 1B configuring a main unit of the image forming apparatus 1. Accordingly, the sensor bracket 100 can be set to a state where the sensors 100A approach to the transfer unit 200, as shown in FIG. 4A, and a state where the sensors 100A separate from the transfer unit 200, as shown in FIG. 4B, respectively.

Figure 5:
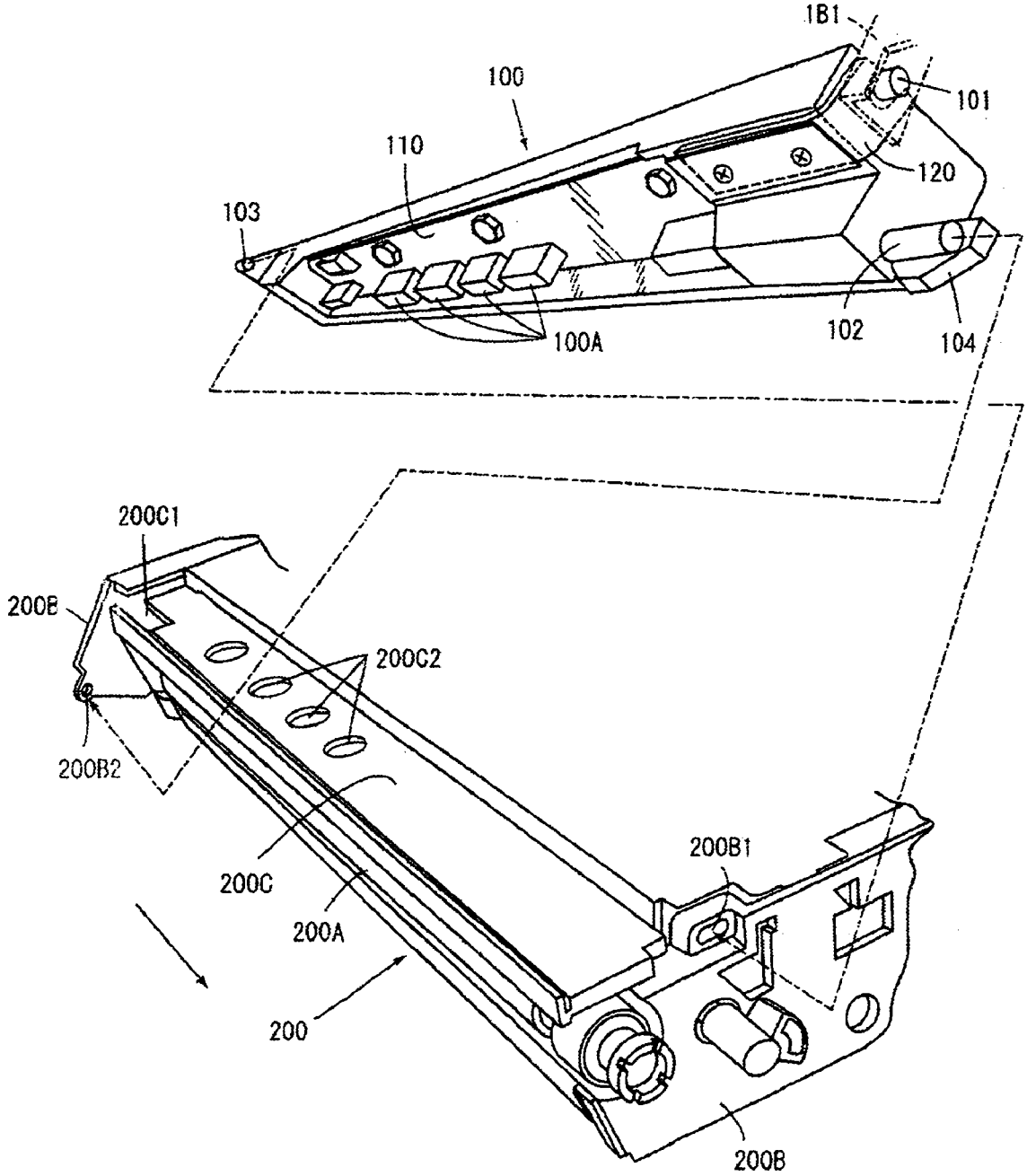
FIG. 5 is a perspective view for explaining an engagement relationship between the sensor bracket and the transfer unit-shown in FIGS. 4A and 4B.

In FIG. 3, position retaining pins 102 and 103 serving as engaging members are respectively provided on the one end wall 100B and the other end wall 100C of the sensor bracket 100 in the longitudinal direction, and the position retaining pins 102 and 103 can be inserted into engaging holes serving as fitting portions, which are provided on respective ends, in a longitudinal direction, of a case 200B of the transfer unit 200, as shown with reference numerals 200B1 and 200B2 in FIG. 5.

The engaging holes 200B1 and 200B2 on the transfer unit 200 are engaged with the position retaining pins 102 and 103 so that an inclination of the sensor bracket 100 in the longitudinal direction, namely, in an inserting direction of the unit and a positional deviation of an end of the sensor bracket 100 in a direction perpendicular to the inserting direction can be prevented, namely, a position of the sensor bracket 100 in a direction perpendicular to an inserting direction of the transfer belt 200A is defined.

FIG. 5 is a perspective view of a state that an orientation of the sensor bracket 100 to the transfer unit 200 is reversed in a horizontal direction in order to clarify the configurations of the position retaining pins 102 and 103 in the sensor bracket 100. At the inserting time of the transfer unit 200, the engaging hole 200B1 positioned on a front side, in the inserting direction, of the transfer unit 200 indicated by arrow is switched to a hole in which the position retaining pin 103 on the sensor bracket 100 swingablly supported on the case 1B is inserted.

An interfering protrusion 104 projecting toward the transfer unit 200 is provided on the one end wall of the 100B of the sensor bracket 100 in the longitudinal direction.

The interfering protrusion 104 is formed so as to have an slope face 104A opening from a front end, in the inserting direction, of the transfer unit 200 inserted into the case 1B toward a rear side thereof in a projecting direction.

The sensor bracket 100 is a member that can swing an end portion at which the interfering protrusion 104 is positioned about the supporting pin 101, and when a pushing-up force from beneath does not act on the sensor bracket 100, the interfering protrusion 104 is positioned in an inserting path for the transfer unit 200 by an engaging portion (not shown) provided on the case 1B.

Figure 6:
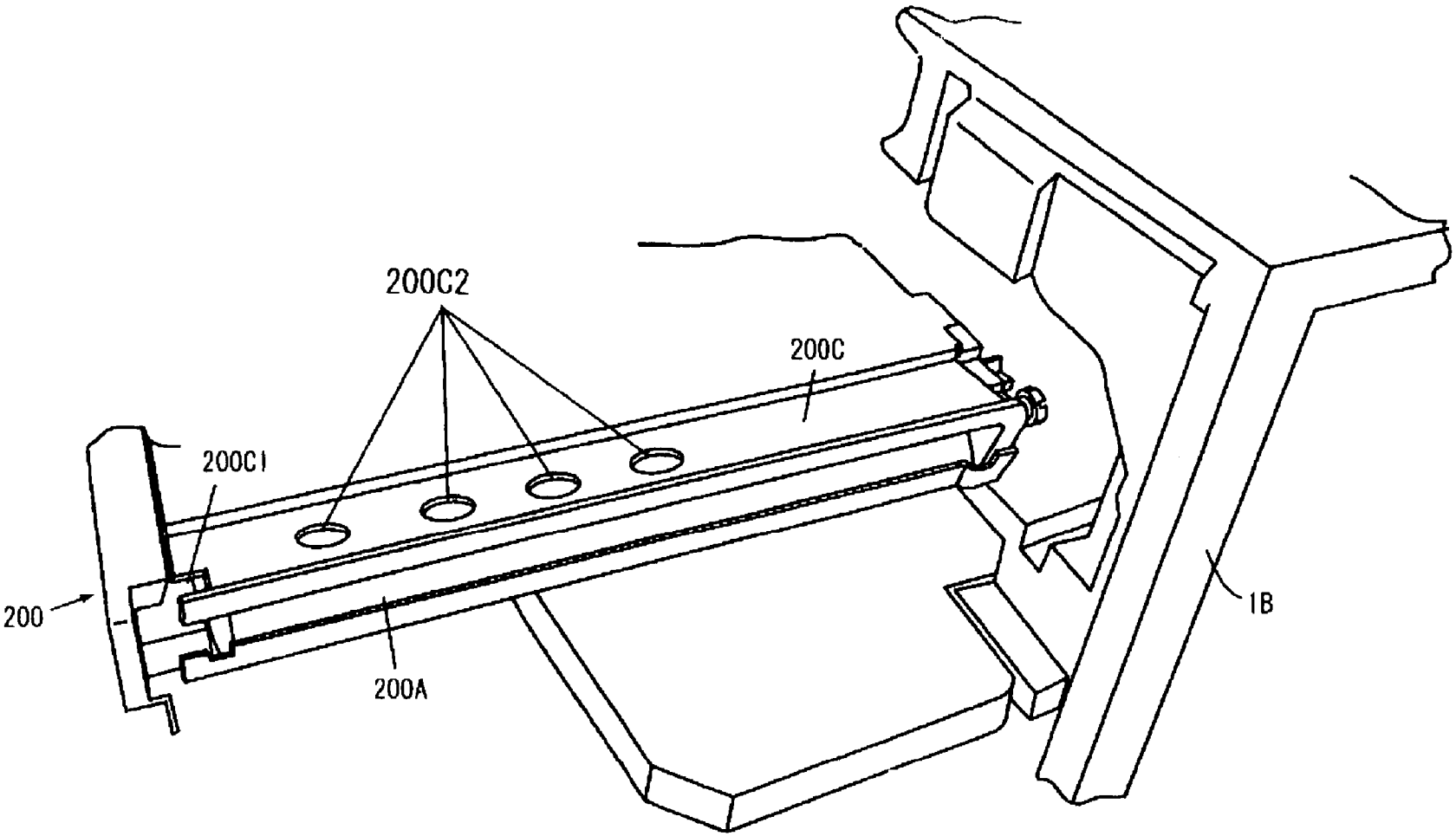
FIG. 6 is a perspective view of a state that the transfer unit shown in FIG. 3 is inserted.

On the other hand, a belt cover designated with a reference numeral 200C in FIGS. 5 and 6 is provided on an upper face of the transfer unit 200 opposed to the interfering protrusion 104 of the sensor bracket 100.

The belt cover 200C is a cover member where a portion thereof opposed to the secondary transfer device 11 (see FIG. 1) that transfers images carried on the transfer belt 200A in batch is opened and an upper face thereof serves as a portion covering the vicinity of a roller for the transfer belt 200A. An upper face of the belt cover 200C opposed to an extending face of the transfer belt 200A entrained about rollers is opposed to the interfering protrusion 104.

A notch designated with reference numeral 200C1 in FIGS. 5 and 6 is formed at an end portion, in the longitudinal direction, of the belt cover 200C corresponding to the rear end in the inserting direction of the transfer unit 200.

The notch 200C1 is provided at a portion of the belt cover 200C through which the interfering protrusion 104 can fall before insertion of the transfer unit 200 is completed, namely, just before the engaging holes 200B1 and 200B2 on the transfer unit 200 are respectively engaged with the position retaining pins 102 and 103 positioned on the sensor bracket 100. The notch 200C1 has such a size that the whole shape/portion of the interfering protrusion 104 can pass through the notch.

With such a configuration, the engaging holes 200B1 and 200B2 on the transfer unit 200 side can engage the position retaining pins 102 and 103 on the sensor bracket 100 side just after the interfering protrusion 104 fall in the notch 200C1, and such a state that the interfering protrusion 104 on the sensor bracket 100 side has fallen in the notch 200C1 on the transfer unit 200 side can be maintained.

A positional relationship between the sensor bracket 10Q and the transfer belt 200A housed in the transfer unit 200 is set to a positional relationship where a sensing distance of the sensor 100A can be obtained.

FIG. 4A and 4B are explanatory views of an opposite relationship between the belt cover 200C on the transfer unit 200 and the interfering protrusion 104 on the sensor bracket 100 side. FIG. 4A corresponds to a state that the inference protrusion 104 has fallen in the notch 200C1 formed on the belt cover 200C on the transfer unit 200, and FIG. 2B corresponds to a state that the interfering protrusion 104 is brought onto an upper face of the belt cover 200C.

The state shown in FIG. 4A includes a state that the transfer unit 200 is not inserted in the case 1B, where the sensor bracket 100 comes into a state that it hangs through swinging of an end portion at which the interfering protrusion 104 is positioned about the supporting pin 101.

The state shown in FIG. 4B is a state that the interfering protrusion 104 on the sensor bracket 100 side is brought onto the upper face of the belt cover 200C, where, since the interfering protrusion comes out of the inserting path for the transfer unit 200, insertion of the transfer unit 200 is not blocked.

The state shown in FIG. 4A corresponds to a state that the position retaining pins 102 and 103 and the engaging holes 200B1 and 200B2 on the transfer unit 200 have engaged with each other and the inserted transfer unit 200 is united to the sensor bracket 100, where a positional relationship between the transfer belt 200A housed in the transfer unit 200 and the sensors 100A on the sensor bracket 100, namely, a space between the transfer belt 200A and the sensors 100A opposed to each other, is defined to form a sensing distance (L).

According to the present embodiment, since the positional relationship between the sensors 100A positioned on the sensor bracket 100 and the transfer belt 200A where positions and densities of images are detected by the sensors. Namely, the positional relationship in the direction perpendicular to the inserting direction of the unit and the opposite space between members opposed to each other are defined utilizing an inserting operation of the transfer unit 200, it is unnecessary to position the sensor bracket 100 and the transfer unit 200 individually. Accordingly, an assembling work of the sensors 100A applied to the transfer unit 200 to be inserted can be simplified.

A modification of a principal portion according to the present embodiment will be explained next.

In FIG. 5, an electrically conductive member 110 electrically connecting respective sensors 100A is provided on the sensor bracket 100.

The electrically conductive member 110 is configured of a thin plate member made of metal positioned on terminal sides at the sensors 100A to function as a bus bar.

The thin plate conductive member 110 is integrated with a member a member that applies, to the sensor bracket 100, a moving property toward one direction in a longitudinal direction of the sensor bracket 100.

In FIG. 5, as a member that applies, to the sensor bracket 100, a moving property toward one direction in a longitudinal direction of the sensor bracket 100, an electrically conductive resilient plate 120 disposed between a supporting plate 1B1 provided on the case 1B and the sensor bracket 100 is used. Since the sensor bracket 100 is always pressed by the supporting plate 1B1, an electrically conductive path including the electrically conductive member 110 and the resilient plate 120 is configured, which results in a bus bar for a power supply and ground side to the sensors 100A.

In this configuration, since a power supply and ground terminal for the sensors provided on the sensor bracket 100 is configured of the thin electrically conductive member 110, the resilient member 120 united thereto, and the supporting plate 1B1 pressingly brought in contact with the resilient plate 120, it is made unnecessary to provide a harness for the sensors 100A or the like. As a result, connecting work for harness is made unnecessary, so that the number of parts and the number of steps for assembling work can be reduced.

A modification of the belt cover 200C on the transfer unit 200 will be explained next.

In FIGS. 5 and 6, a configuration that prevents contaminating material from entering to the sensors 100A on the sensor unit 100 is provided on the belt cover 200C.

As the contaminating material to the sensors 100A, there is toner powder, which forms an image transferred on the transfer belts 200A. Since toner powder merely adheres to the transfer belt 200A electrically, the toner powder is influenced by air flow generated around the transfer belt 200A at a moving time of the transfer belt 200A, and the powder easily floats. Furthermore, since the vicinity of the exposing portion for the transfer belt 200A formed in the transfer unit 200 is also influenced by air flow, such a phenomenon may occur that toner powder removed from the transfer belt 200A by the cleaning device 13 (see FIG. 1) or dust floating in the case 1B easily adhere to detecting face of the sensors 100A by air flow.

Therefore, the belt cover 200C is configured to shield a space between the transfer belt 200A and the sensors 100A except for a portion of the belt cover 200C that is opposed to the sensors 100A. In the configuration shown in FIGS. 5 and 6, an opening 200C2 is formed at a portion of the belt cover 200C that is opposed to an arrangement portion of the sensors 100A.

In this configuration, since a space between the transfer belt 200A and the sensors 100A is shielded except for the arrangement portion of the sensors 100A, toner powder floating from the transfer belt 200A can be suppressed from reaching the sensors 100A. When optical sensors are used as the sensors 100A, contamination on detecting faces of the sensors is prevented so that lowering of detection accuracy can be suppressed.

Such a configuration may be adopted that a shutter that opens and closes the opening 200C2 provided in the belt cover 200C is provided for the opening 200C2 and the detecting faces of the sensors 100A is prevented from being contaminated due to scattering of toner powder from interior of the transfer unit 200 by closing the shutter except for an activating time of the sensors 100A.

Figure 7:
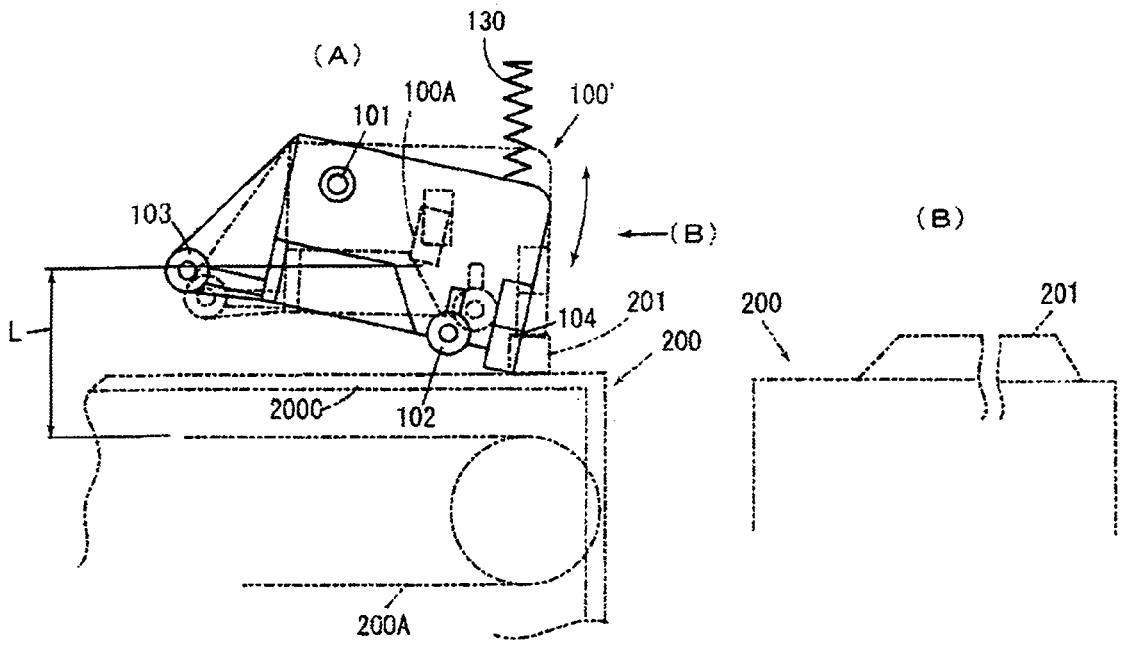
FIG. 7 is a schematic diagram of one of modifications regarding the configuration of the sensor bracket and the transfer unit shown in FIG. 3.
Figure 8:
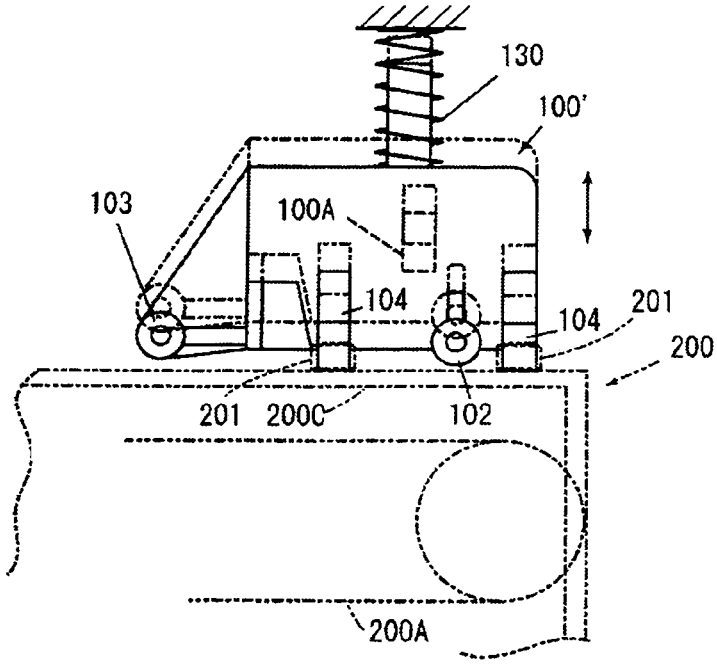
FIG. 8 is a schematic diagram of another modification regarding the configuration of the sensor bracket and the transfer unit shown in FIG. 3.

As the configuration for defining the relative positional relationship between the transfer unit 200 inserted into the case and the sensor bracket 100 that is opposed thereto, a configuration shown in FIGS. 7A, 7B, and 8 can be employed.

The configuration shown in FIGS. 7A, 7B, and 8 has such a feature that the sensor bracket 100 can displace to approach to and separate from the transfer unit 200. That is, in the configuration shown in FIGS. 7A, 7B, and 8, a sensor bracket (designated with reference numeral 100', expediently) that can swing to approach to and separate from the transfer unit 200 is provided and such a resilient member 130 as a spring that always biases the sensor bracket 100' to the transfer unit 200 side pressingly is arranged at a swinging end of the sensor bracket 100'.

With this configuration, as a member that swings the sensor bracket 100' to approach to and separate from the transfer unit 200, a trapezoidal interfering protrusion, designated with reference numeral 201 in FIG. 5, that can set a relative positional space (a sensing distance: L) between the sensor bracket 100' and the transfer unit 200 and has a height allowing the sensor bracket 100' to separate from the transfer unit 200 is provided on an upper face of the belt cover 200C in the transfer unit 200 instead of the notch shown in FIG. 5 like the case that the notch is provided according to the present embodiment shown in FIG. 5. FIG. 7B is a view seen from a direction designated with reference numeral (B) in FIG. 7A.

In this configuration, when the transfer unit 200 is inserted into the case 1B of the printer, the sensor bracket 100' is brought onto the interfering protrusion 201 provided on the belt cover 200C to be swung so as to deviate from the inserting path for the transfer unit 200. Just before insertion of the transfer unit 200 is completed, a lower portion of the interfering protrusion 201 abuts on the sensor bracket 200, so that the sensor bracket 100' swings toward the transfer unit 200. As a result, positioning conducted in the state that the sensing distance is set and the engaging holes on the transfer unit 200 side, and the position retaining pins on the sensor bracket 100' engage each other.

The configuration shown in FIG. 8 is the same as that shown in FIGS. 7A and 7B except for the sensor bracket 100' shown in FIGS. 7A and 7B being supported so as to be movable upwardly and downwardly instead of the swingable configuration. In this configuration, the sensor bracket 100' displaces upwardly or downwardly according to an inserted state of the transfer unit, and upon completion of the insertion, the sensor bracket 100' is pushed to the transfer unit by a biasing force of the resilient member 130, so that the relative positional relationship between the sensor bracket 100' and the transfer unit is defined. In this configuration shown in FIG. 8, an interfering protrusion 104 and the interfering protrusion 201 are arranged symmetrically regarding an arrangement position of the resilient member 130 in order to prevent the sensor bracket 100' from inclining at a time of upward and downward movements of the sensor bracket 100'.

According to the present embodiment, the transfer unit is explained as an object to be inserted into and pulled from the image forming apparatus. As shown in FIG. 2, however, the photoconductor unit or the imaging unit may be the object to be inserted and pulled out and a positional relationship inherent to the object may be defined.

Furthermore, according to the present invention, since the configuration for setting an opposite positional relationship between the unit and the member in the course of unit insertion by the unit is provided, a proper opposite positional relationship can be obtained only by using the member directly without performing individual positioning.

Moreover, according to the present invention, apposition in the direction perpendicular to the inserting direction of the unit and the space between the unit and the member opposed thereto can be set as the opposite positional relationship. Particularly, since the present invention is provided with the configuration that engagement is achieved in response to an inserting operation of the unit, operations except for the inserting operation are not required for positioning. Accordingly, the number of steps for an assembling work can be reduced.

Furthermore, according to the present invention, since the configuration that the member to be opposed is pushed and moved by the unit put in the inserting course to separate from the unit and the member can move toward the unit is employed, the member does not obstruct insertion of the unit and an opposite space between the unit and the member opposed to each other is defined after the insertion. Particularly, according to the present invention, by the configuration that the member that can approach to and separate from the unit is provided and the member separates from the unit due to interference with the unit at the time of insertion of the unit and by the configuration that the member is supported swingablly in direction of approaching to and separating from the unit and the member swings in the direction of separating from the unit due to interference with the unit at a time of insertion of the unit-according to the present invention, the opposite space between the unit and the member opposed is defined at a time when the member returns back to its original or home position after the separation, so that an inspecting work of the opposite space after assembling the unit or the like becomes unnecessary.

Moreover, according to the present invention, since the opposite positional relationship between the unit and the member can be defined according to insertion of the unit, an existing configuration may be utilized without performing a special positioning work or using a positioning mechanism. Accordingly, improvement in positioning workability and simplification of the configuration can be achieved.

Furthermore, according to the present invention, since the relative positional relationship between the transfer unit provided with the transfer member and the sensor bracket provided with the sensors that can detect images carried by the transfer member can be defined as the configuration for defining the relative positional relationship, states of formed images can be detected properly.

Moreover, according to the present invention, since the sensors provided on the sensor bracket can detect at least positions of images on the transfer member and densities of the images and the number of images carried on'the transfer member is plural, accuracy in detection for out of color registration due to deviation occurring among respective image positions can be prevented from lowering by defining the opposite positional relationship between the transfer-member and the sensor bracket opposed.

Furthermore, according to the present invention, since the thin plate-like electrically conductive member that can connect a plurality of sensors electrically is provided, wiring among respective sensors is made unnecessary. Accordingly, cost reduction can be made possible owing to that harness material required for a wiring work or wires is not used.

Moreover, according to the present invention, since the sensor bracket is provided with a member disposed between the sensor bracket and the case to apply one-direction moving property to the sensor bracket, and the resilient member is used as the member applying one direction moving property to the sensor bracket, a forcible positioning in one direction is performed with a simple configuration. Accordingly, backlash due to a working error of parts is avoided so that positioning accuracy can be prevented from lowering.

Furthermore, according to the present invention, since the member applying the one direction moving property to the sensor bracket and the member connecting the respective sensors electrically are united to configure an electrically conductive portion extending to the case, it is unnecessary to provide an electrically conductive portion connecting to the case side. Accordingly, simplification of the configuration can be achieved.

Moreover, according to the present invention, since the case is shielded from the outside thereof except for a portion of the case that is positioned on the transfer unit and is opposed to the sensor bracket, contaminating materials are prevented from entering in the sensors from outside thereof, so that sensitivities of the sensors can be prevented from lowering.

Furthermore, according to the present invention, since the case is provided with an opening at a portion of the case that is positioned on the transfer unit and is opposed to the sensor bracket and the opening is opened at a time of insertion completion of the unit, foreign matters are securely prevented from entering in the case at a time of insertion of the unit, so that sensitivities of the sensors can be prevented from lowering at a detection starting time.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A unit supporting device that supports a unit that can be inserted into an accommodating position and pulled out to an operable position while defining a position of the unit with respect to a member opposite to the unit, wherein a configuration for setting a positional relationship between the unit and the member in a process in which the unit is inserted toward the accommodating position is provided on the unit and the member; and a configuration for setting a positional relationship between the unit and the member in a direction perpendicular to a direction of inserting the unit includes an engaging portion provided on the unit at a front side and a rear side in the direction of inserting the unit; and a fitting portion provided on the member at positions corresponding to the engaging portion, and positioning in the direction perpendicular to the direction of inserting the unit is set by engaging the engaging portion and the fitting portion when the inserting the unit is completed.

2. The unit supporting device according to claim 1, wherein the positional relationship is defined based on a position of the unit and a distance between the unit and the member in a direction perpendicular to a direction of inserting the unit.

3. The unit supporting device according to claim 2, wherein a configuration for setting the distance between the unit and the member is such that the member is pushed and moved by a portion of the unit put in the process of inserting the unit so that the member is separated from the unit, the member moves toward the unit when the inserting the unit is completed, and a stopping position of the member is defined.

4. The unit supporting device according to claim 3, wherein a configuration, in which the member separates from the unit in the process of inserting the unit, and the member moves toward the unit when the inserting the unit is completed, and a stopping position of the member is defined, employs a configuration in which the member is supported so as to be displaceable in directions of approaching to and separating from the unit, the member interferes with a portion of the unit in the process of inserting the unit to displace so as to be spaced from the unit, and the member is released from the interference, when the inserting the unit is completed, to displace toward the unit to a predetermined position.

5. The unit supporting device according to claim 3, wherein a configuration, in which the member separates from the unit in the process of inserting the unit, and the member moves toward the unit when the inserting the unit is completed, employs a configuration in which the member is supported swingablly in directions of approaching to and separating from the unit, the member interferes with a portion of the unit in the process of inserting the unit to swing in the direction of separating from the unit, and the member is released from the interference, when the inserting the unit is completed, to swing toward the unit to a predetermined position.

6. An image forming apparatus comprising a unit supporting device that supports a unit that can be inserted into an accommodating position and pulled out to an operable position while defining a position of the unit with respect to a member opposite to the unit, wherein the unit supporting device includes:

a configuration for setting a positional relationship between the unit and the member in a process in which the unit is inserted toward the accommodating position is provided on the unit and the member; and a configuration for setting a positional relationship between the unit and the member in a direction perpendicular to a direction of inserting the unit includes an engaging portion provided on the unit at a front side and a rear side in the direction of inserting the unit; and a fitting portion provided on the member at positions corresponding to the engaging portion, and positioning in the direction perpendicular to the direction of inserting the unit is set by engaging the engaging portion and the fitting portion when the inserting the unit is completed.

7. The image forming apparatus according to claim 6, wherein the unit is a transfer unit with a transfer member that is inserted from outside toward an insertion position, and the member is arranged opposite to the transfer unit.

8. The image forming apparatus according to claim 7, wherein the member opposite to the transfer unit is a sensor bracket that is provided at an inserting position of the transfer unit on a case of a main unit of the image forming apparatus, and that detects a surface of the transfer member.

9. The image forming apparatus according to claim 8, wherein the sensor bracket detects an image carried on the transfer member.

10. The image forming apparatus according to claim 9, wherein the sensor bracket is supported swingablly to the case, a swinging end of the sensor bracket can abut on an upper surface of the transfer unit, and the sensor bracket interferes with the upper surface in a process of inserting the transfer unit so as to deviate from an insertion path.

11. The image forming apparatus according to claim 10, wherein a plurality of sensors is provided in the sensor bracket along a direction of inserting the transfer unit, and the sensors detect at least a carrying position and a density of the image.

12. The image forming apparatus according to claim 11, wherein the transfer member carries a color image having a plurality of colors, and the sensors detect a transfer position of each of the colors.

13. The image forming apparatus according to claim 11, wherein the sensor bracket includes a thin plate-like electrically conductive member that electrically connects the sensors.

14. The image forming apparatus according to claim 11, wherein the transfer unit includes a casing that houses the transfer member, one portion of the casing is shielded from the outside, and other portion of the casing is opposite to the sensors.

15. The image forming apparatus according to claim 14, wherein the other portion has an opening with a size allowing detection by the sensors.

16. The image forming apparatus according to claim 15, wherein the sensors detect a position of an image formed by an imaging station.

17. The image forming apparatus according to claim 8, wherein the sensor bracket includes a property applying member that applies one directional moving property to the sensor bracket between the sensor bracket and the case.

18. The image forming apparatus according to claim 14, wherein the property applying member is a resilient member disposed between one end of the sensor bracket in a longitudinal direction and the case.

19. The image forming apparatus according to claim 8, wherein the sensor bracket includes, a thin plate-like electrically conductive member that electrically connects sensors, and a property applying member that is a resilient member disposed between one end of the sensor bracket in a longitudinal direction and the case, and wherein the electrically conductive member and the resilient member are integrated to form an electrically conductive portion between the sensors on the sensor bracket and the case.

* * * * *